US005503274A

United States Patent [19]

Toffler et al.

[11] Patent Number: 5,503,274

[45] Date of Patent: Apr. 2, 1996

[54] BOTTLE ITEM

[75] Inventors: Jerri L. Toffler, Clinton Township; Louis E. Hough, St. Clair Shores, both of Mich.

[73] Assignee: Heidi-Ho Corp., Roseville, Mich.

[21] Appl. No.: 357,391

[22] Filed: Dec. 16, 1994

[51] Int. Cl.[6] ..... A63H 3/00

[52] U.S. Cl. ..... 206/457; 446/73

[58] Field of Search ..... 206/457, 459.5; 446/73; 472/57

[56] References Cited

U.S. PATENT DOCUMENTS

| | | | |
|---|---|---|---|
| 2,498,074 | 2/1950 | Feldman | 472/57 X |
| 2,823,490 | 2/1958 | Griem | 206/457 X |
| 4,573,571 | 3/1986 | Leem | 206/457 X |
| 5,261,848 | 11/1993 | Kaplan et al. | 472/57 X |

*Primary Examiner*—Jacob K. Ackun
*Attorney, Agent, or Firm*—Howard & Howard

[57] ABSTRACT

An item-in-a-bottle generally includes a container having the general appearance of a fully intact soft drink bottle. The container has an inwardly curving lower wall portion which defines a large orifice in the bottom of the container. A deformable item, which may be a toy, having at least one dimension greater than the diameter of the container and is inserted through the large orifice. The bottom of the container is inserted into an opaque base which covers the large orifice in the bottom of the container. The opaque base conceals the large orifice on the bottom of the container from view, thereby providing the appearance of a fully intact soft drink bottle. The process for molding the bottle will preferably be by blow-molding. This provides extra clarity, flexibility and is unbreakable. Many products such as sporting items, candy and flowers can be encased in the bottle.

21 Claims, 3 Drawing Sheets

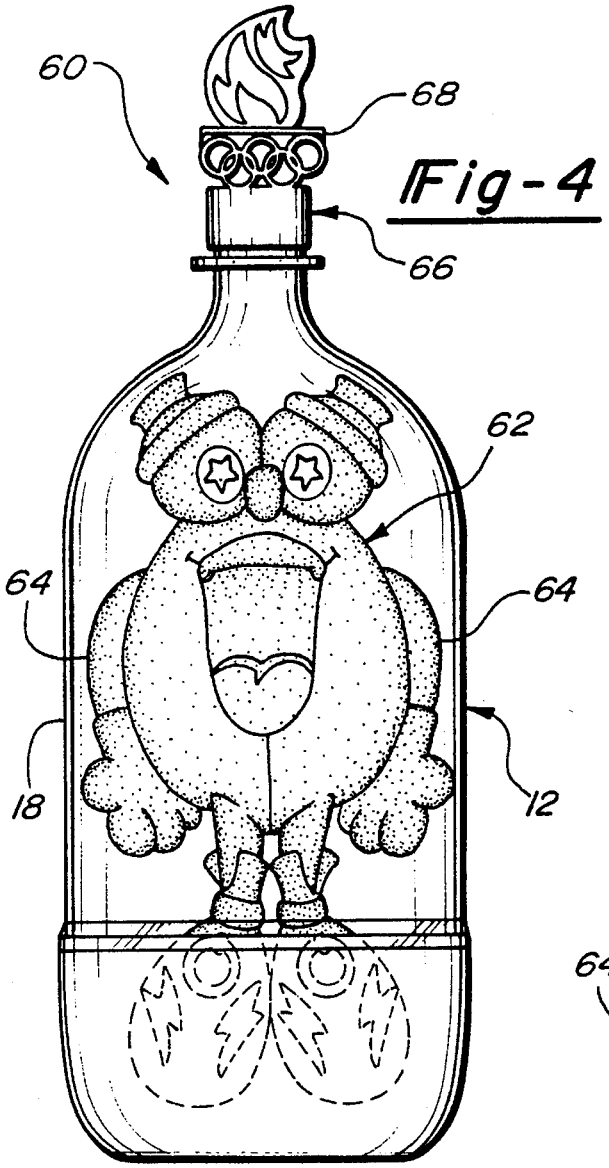
Fig-4
Fig-5
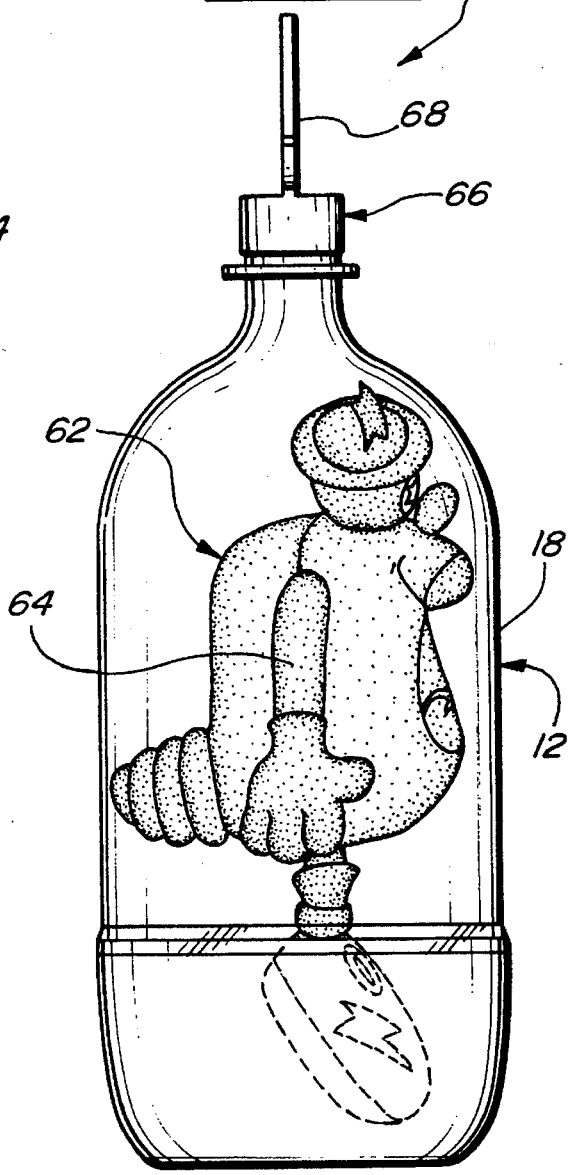

BOTTLE ITEM

BACKGROUND OF THE INVENTION

The present invention relates to an item in which a container has the appearance of a fully intact plastic bottle such as are currently used for soft drinks, but allows the item, which may be a toy or sports item, to be removed and returned through a concealed orifice in the bottom of the container. The container initially serves as packaging for the item during display for sale and later serves as a carrying case and display case A toy ship within a glass bottle has long been a popular display piece which intrigues observers as to how the ship got into the bottle. However, glass bottles are not suitable for young children or for transportation of the toy. Further, the known ship-in-a-bottle design does not permit the child to remove the ship for play and return the ship to the bottle for storage or display.

SUMMARY OF THE INVENTION

The present invention provides an item which utilizes a modern plastic bottle design and allows the removal and return of the item to the container. During display or storage, the item-in-a-bottle will appear as a deformable item, such as a stuffed bear, disposed within a modern plastic bottle which appears to be fully intact. The container can have the logos and indicia. As an example, current favorite soft drink brand indicia could be used. An item in a container, according to the present invention, piques the curiosity of observers as to how the item, which is much larger than the neck of the bottle, got into the bottle.

The item-in-a-bottle includes a container having the shape and size similar to one of any currently used plastic bottles such as are used for soft drinks. The container has a generally cylindrical body having an inwardly curving upper wall portion and an inwardly curving lower wall portion. The inwardly curving upper wall portion is continuous with the neck of the bottle which defines a small orifice at the top of the container. The inwardly curving lower wall portion defines a large orifice in the bottom of the container. The container can be molded having the large orifice in the bottom of the container. Alternatively, the container can be molded as a fully intact bottle, in which case the bottom of the container is removed by making a circular cut between the inwardly curving upper wall portion and the bottom wall of the container.

An item, which may be a deformable item, such as a stuffed bear, having at least one dimension larger than the diameter of the large orifice, and in some cases, even the diameter of the cylindrical body of the container, is deformed inwardly or "squeezed" and inserted through the large orifice in the bottom of the container. Inside the container, the deformable item is released and imparts a force radially outwardly on the container thereby retaining the deformable item within the container.

The bottom of the container is then inserted into an opaque base having a cylindrical wall continuous with a bottom wall. The opaque base provides stability to the item-in-a-bottle and conceals the large orifice from view while being consistent with the current design of plastic bottles. The inwardly curving wall portion at the large orifice assists in retaining the deformable item, which has a diameter larger than the large orifice.

During display for sale, an adhesive tape may be affixed about the circumference of the container and the base thereby securing the base to the container. A cap is threaded on the neck of the container over the small orifice in the top of the container. The cap may include a decoration that is preferably selected to be consistent with the item in the bottle.

BRIEF DESCRIPTION OF THE DRAWINGS

The above, as well as other advantages of the present invention, will become readily apparent to those skilled in the art from the following detailed description of a preferred embodiment when considered in the light of the accompanying drawings in which:

FIG. 4 is a front view of another embodiment of the item-in-a-bottle.

FIG. 5 is a side view of the item-in-a-bottle of FIG. 4; and

DESCRIPTION OF THE PREFERRED EMBODIMENT

Figure 1:
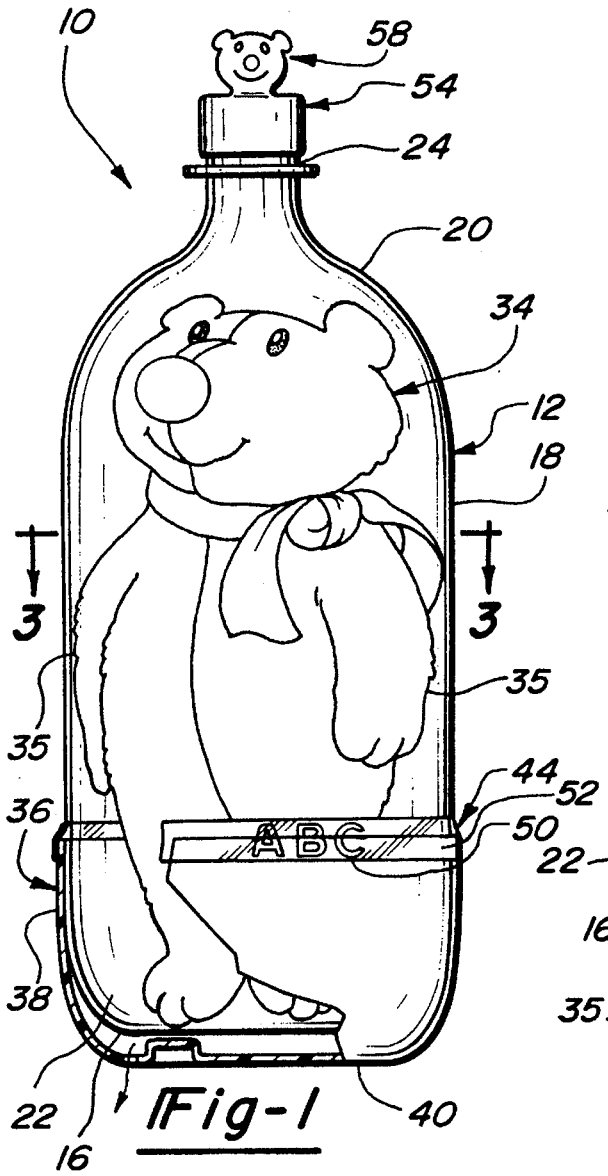
FIG. 1 is a front view of an item-in-a-bottle in accordance with the present invention.
Figure 3:
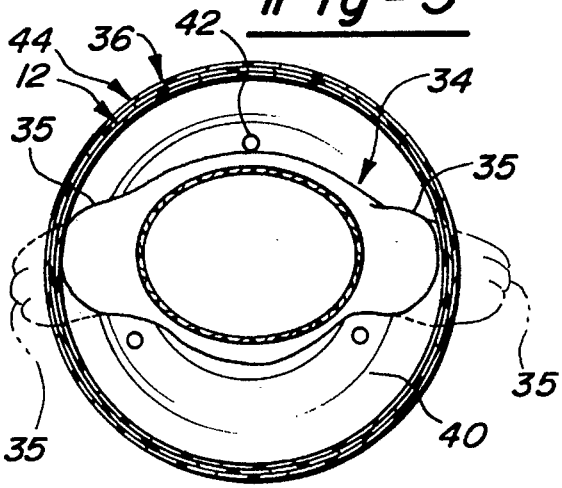
FIG. 3 is a sectional view of the item-in-a-bottle, taken along line 3—3 in FIG.
Figure 2:
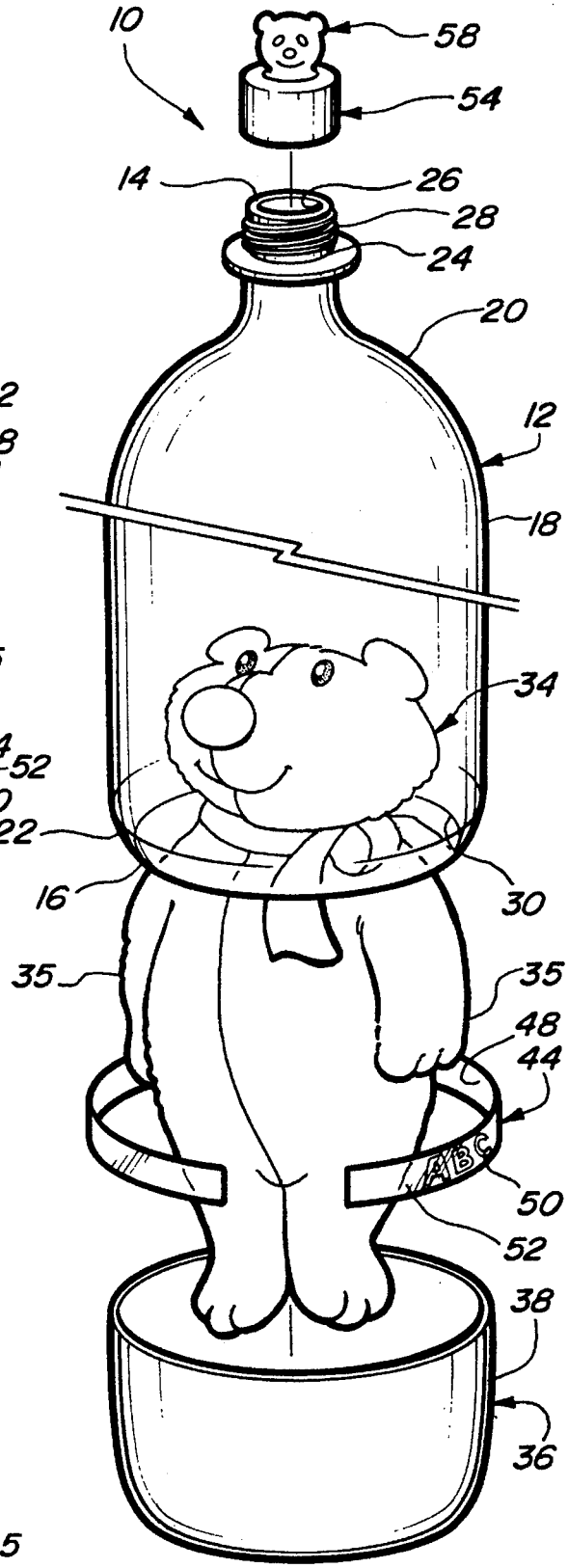
FIG. 2 is an exploded perspective view of the item-in-a-bottle of FIG. 1.

Referring to FIG. 1–3, an item-in-a-bottle 10 according to one embodiment of the present invention includes a container 12 having a top 14 and a bottom 16. The container 12 is preferably made of a transparent plastic and is preferably formed generally in the shape and size of a bottle such as is currently used for soft drinks. Preferably, the two-liter size is utilized. The container 12 has a cylindrical body 18 having an inwardly curving upper wall portion 20 and a inwardly curving lower wall portion 22. The container 12 also includes a neck portion 24 having a diameter much smaller than the cylindrical body 18. The neck portion 24 is continuous with the upper wall portion 20 and defines a small orifice 26 at the top 14 of the container 12. The neck portion 24 includes an threaded outer surface 28.

The lower wall portion 22 of the container 12 defines a large orifice 30 at the bottom 16 of the container 12. The container 12 can be molded having the large orifice 30. Alternatively, the container can be molded as a solid bottle having a bottom wall continuous with the lower wall portion 22, in which case the bottom wall is removed by making a circular cut between the inwardly curving lower wall portion 22 and the bottom wall. In either method, it is preferred that the bottom does curve inwardly to assist in holding the item in the bottle.

A deformable item 34 having at least one dimension 35 greater than the diameter of the orifice 30, and in this case, the cylindrical body 18 is deformed inwardly and inserted through the large orifice 30 of the container 12. For example, a deformable toy 34 shown in FIGS. 1–3 as a stuffed bear has front paws 35 or "arms" which in their undeformed state, shown in phantom in FIG. 3, protrude a distance greater than the diameter of the cylindrical body 18. Inside the container 12, the deformable toy 34 is released, allowing the paws 35 to bias the cylindrical body 18 radially outwardly, thereby retaining the deformable toy 34 within the container 12.

An opaque base 36 includes a cylindrical wall 38 continuous with a bottom wall 40 and a plurality of apertures 42 in the bottom wall 40. Preferably the base 36 is formed of an opaque plastic. The cylindrical wall 38 has an inner diameter slightly larger than the outer diameter of the cylindrical body 18 of the container 12. The bottom 16 of the container 12 is inserted into the base 36 until the lower wall portion 22 abuts the bottom wall 40 of the base 36, covering the large orifice 30 and concealing it from view.

An adhesive tape 44 preferably comprises an adhesive (not shown) on a first surface 48 and decorative or informational indicia 50 on an opposite second surface 52. The adhesive tape 44 is disposed about the circumference of the cylindrical body 18 and the base 36, securing the base 36 to the container 12.

A cap 54 has an inner threaded surface (not shown) complementary to the externally threaded outer surface 28 of the neck portion 24. The cap 54 may include a decoration 58 which is formed integrally with the cap 54 or secured to the cap 54 with an adhesive or other suitable means. The decoration is preferably associated with the item. Here, the cap and item are bears.

The item-in-a-bottle 10 provides a container 12 which serves initially as packaging for the item 34 and later serves as a carrying case or storage for the item 34. Since the container 12 is transparent, it can also be used to display the item 34 while keeping it free of dust and dirt.

By forming the large orifice 30 below the inwardly curving lower wall portion 22 the transverse integrity of the container 12 is reinforced by the inwardly curving lower wall portion 22. Because the deformable item 34 has at least one undeformed dimension 35 which is greater than the diameter of the orifice 30, the lower wall portion 22 retains the item in the bottle. The item's largest dimension is also preferably larger than the bottle's largest dimension, thus assisting in retaining the item.

The removable opaque base 36 conceals the large orifice 30 and provides the container 12 with the appearance of an intact soft drink bottle, piquing the curiosity of observers as to how the deformable item 34 got into the container 12. Further, the base 34 provides stability to the item-in-a-bottle 10. During insertion of the container 12 into the base 36, air within the container 12 is released through the apertures 42 in the bottom wall 40 of the base 36, thereby facilitating the assembly and removal of the base 36 and container 12.

The adhesive tape 44 secures and seals the base 36 to the container 12 during display for sale. Additionally, the indicia 50 on the second surface 52 of the adhesive tape 44 can include decoration, logos, or information.

Figure 6:
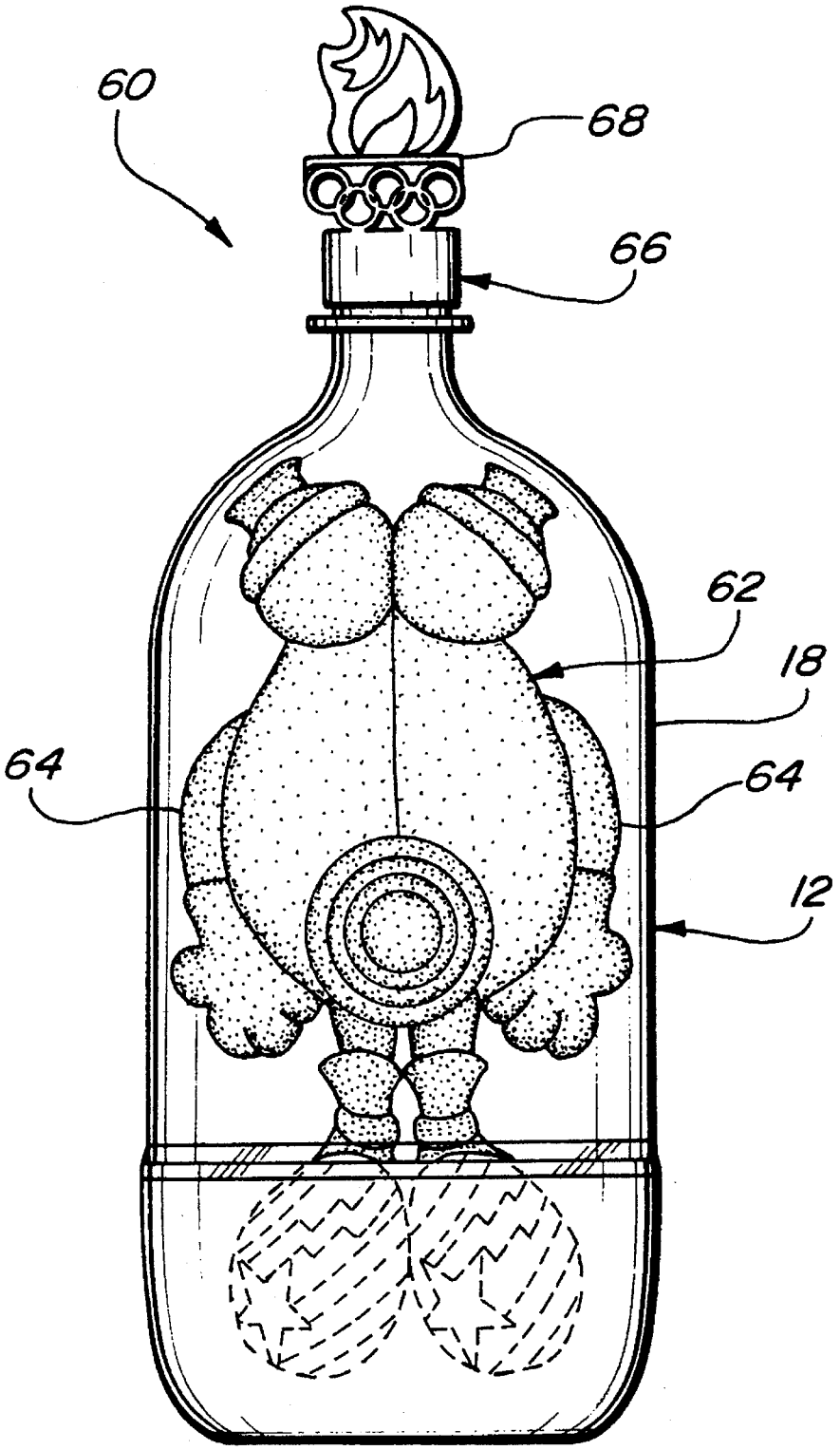
FIG. 6 is a rear view of the item-in-a-bottle shown in FIG. 4.

It should be apparent that other items, including deformable toys could be used in place of the deformable item 34, which is shown in FIGS. 1–3 as a stuffed bear. For example, in FIGS. 4–6 the item-in-a-bottle 60 includes a deformable toy 62 which is the mascot for the 1996 Olympic Games. For the reasons described above, the deformable toy 62 preferably has at least one undeformed dimension 64 which is greater than the diameter of the cylindrical body 18. In this embodiment, the deformable toy 62 has arms 64 which in their unreformed state have a span greater than the diameter of the cylindrical body 18. The arms 64 are deformed inwardly during insertion of the of the deformable toy into the container 12. The arms 64 provide a radially outward bias on the cylindrical wall 18 having the benefits described above. In this embodiment, an alternative decorative cap 66 is used which includes a decoration 68 having for its shape the Olympic torch and Olympic rings. Again, the cap is associated with the item in the bottle.

In accordance with the provisions of the patent statutes, the present invention has been described in what is considered to represent its preferred embodiment. However, it should be noted that the invention can be practiced otherwise than as specifically illustrated and described without departing from its spirit or scope.

What is claimed is:

1. An item-in-a-bottle comprising:

a container having a top and a bottom, said container comprising:

a transparent, generally cylindrical body having an inwardly curving upper wall portion and a large orifice in the bottom of said container; a neck portion having a diameter less than said cylindrical body, said neck portion continuous with said inwardly curving upper wall portion of said cylindrical body;

a base having a cylindrical wall continuous with a bottom wall, said base disposed on said bottom of said Container over said large orifice; and an item disposed within said cylindrical body of said container, said item being deformable and having at least one undeformed dimension larger than the inner diameter of said large orifice.

2. The item-in-a-bottle according to claim 1, further including a cap disposed on said neck portion, said cap being associated with said item.

3. The item-in-a-bottle according to claim 1, wherein said base is opaque.

4. The item-in-a-bottle according to claim 1, wherein said container further comprises an inwardly curving lower wall portion defining the large orifice in said bottom of said container.

5. The item-in-a-bottle according to claim 1, wherein said deformable item also has a dimension larger than the inner diameter of said cylindrical body, such that said item is deformed in said cylindrical body.

6. An item-in-a-bottle comprising:

a container having a top and a bottom, said container comprising:

a transparent, generally cylindrical body having an inwardly curving upper wall portion and a inwardly curving lower wall portion, said inwardly curving lower wall portion defining a large orifice in the bottom of said container;

a neck portion having a diameter less than said cylindrical body, said neck portion continuous with said inwardly curving upper wall portion of said cylindrical body;

an opaque base having a cylindrical wall continuous with a bottom wall, said cylindrical wall having an inner diameter received on the outer diameter of said cylindrical body of said container wall, said base disposed on said bottom of said container over said large orifice;

a deformable item having at least one dimension larger than the inner diameter of said orifice and said orifice and said cylindrical body of said container when said deformable item is not deformed, said deformable item disposed within said cylindrical body of said container;

an adhesive tape affixed about the circumference of said cylindrical body and said base;

a cap received on said neck portion, thereby sealing said small orifice.

7. An item-in-a-bottle as recited in claim 6, wherein said cap is associated with said item.

8. An item as recited in claim 7, wherein said item-in-a-bottle and said cap both illustrate Olympic-related items.

9. A method for removably packaging an item Comprising the steps of:

a) providing a container having:

a top and a bottom;

a substantially transparent generally cylindrical body having an inwardly curving upper wall portion and an inwardly curving lower wall portion defining a large orifice in said bottom of said container;

an upper neck portion having a diameter less than the diameter of said cylindrical body, .said neck portion continuous with said inwardly curving upper wall portion; and a bottom wall continuous with said inwardly curving lower wall portion b) making a circular cut between said inwardly curving wall portion and said bottom wall;

c) removing said bottom wall from said container, said inwardly curving wall portion thereby defining a large orifice in the bottom of said container;

d) providing a deformable toy;

e) inserting said deformable toy through said large orifice in said bottom of said container;

f) providing a base having a cylindrical wall continuous with a bottom wall, said cylindrical wall having an inner diameter slightly greater than the outer diameter of said cylindrical body of said container; and g) inserting said cylindrical body into said base thereby covering said large orifice.

10. The method according to claim 9, wherein said base is opaque.

11. The method according to claim 9, wherein said base includes at least one aperture in said bottom wall.

12. The method according to claim 9, wherein said deformable toy has at least one undeformed dimension larger than the inner diameter of said cylindrical body of said container, said method further comprising the steps of:

deforming said deformable toy inwardly while inserting said deformable toy through said large orifice in said bottom of said container; and releasing said deformable toy to allow said deformable toy to bias said cylindrical body radially outwardly.

13. The method according to claim 9, wherein said item is deformable.

14. A method for removably packaging an item including the steps of:

providing a container having:

a top and a bottom;

a substantially transparent generally cylindrical body having an inwardly curving upper wall portion and a large orifice in said bottom of said container; and an upper neck portion having a diameter less than the diameter of said cylindrical body, said neck portion continuous with said inwardly curving upper wall portion;

providing an item;

inserting said item through said large orifice in said bottom of said container; providing a base having a cylindrical wall continuous with a bottom wall, said cylindrical wall having an inner diameter slightly greater than the outer diameter of said cylindrical body of said container;

inserting said cylindrical body into said base thereby covering said large orifice;

providing an adhesive tape; and affixing said adhesive tape about the circumference of said cylindrical body and said base, thereby securing said base to said cylindrical body.

15. The method according to claim 14, wherein said neck portion defines a small orifice in said top of said container, said method further comprising the steps of:

providing a cap having an inner surface complementary to said external surface of said neck portion;

engaging said cap with said neck portion, thereby sealing said small orifice.

16. The method according to claim 14, wherein said item is deformable.

17. The method for removably packaging an item comprising the steps of:

providing a container having:

a top and a bottom;

a substantially transparent generally cylindrical body having an inwardly curving upper wall portion and a bottom wall continuous with said cylindrical body; and an upper neck portion having a diameter less than the diameter of said cylindrical body, said neck portion continuous with said inwardly curving upper wall portion;

making a cut in said container above said bottom wall;

removing said bottom wall from said container, said cylindrical body thereby defining a large orifice in the bottom of said container;

providing an item;

inserting said item through said large orifice in said bottom of said container;

providing a base having a cylindrical wall continuous with a bottom wall; and enclosing said large orifice with said base.

18. The method according to claim 17, wherein said item is deformable and has at least one undeformed dimension larger than the inner diameter of said cylindrical body of said container, said method further comprising the steps of:

deforming said deformable item inwardly while inserting said deformable item through said large orifice in said bottom of said container; and releasing said deformable item to allow said deformable item to bias said cylindrical body radially outwardly.

19. The method according to claim 17, further including the steps of:

providing an adhesive tape; and affixing said adhesive tape about the circumference of said cylindrical body and said base, thereby securing said base to said cylindrical body.

20. The method according to claim 17, wherein said container further includes an inwardly curving lower wall portion continuous with said bottom wail, said method further comprising the steps of: making a circular cut between said inwardly curving wall portion and said bottom wall; and removing said bottom wall from said container, said inwardly curving wall portion thereby defining a large orifice in the bottom of said container.

21. The method according to claim 17, wherein said base is a part formed separately from the container.

* * * * *